US008416269B2

(12) United States Patent
Choi et al.

(10) Patent No.: US 8,416,269 B2
(45) Date of Patent: Apr. 9, 2013

(54) LIQUID CRYSTAL DISPLAY DEVICE AND DRIVING METHOD THEREOF

(75) Inventors: Hee Seung Choi, Daegu (KR); Yun Sung Yang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 554 days.

(21) Appl. No.: 12/461,553

(22) Filed: Aug. 14, 2009

(65) Prior Publication Data

US 2010/0079473 A1 Apr. 1, 2010

(30) Foreign Application Priority Data

Oct. 1, 2008 (KR) ..... 10-2008-0096509

(51) Int. Cl.
*G09G 5/10* (2006.01)

(52) U.S. Cl. ..... 345/690; 345/545; 345/549; 345/691; 345/214; 345/58; 348/14.15; 348/407.1; 348/430.1; 348/415.1; 348/452; 348/614; 348/620

(58) Field of Classification Search ..... 348/14.15, 348/407.1, 430.1
See application file for complete search history.

(56) References Cited

U.S. PATENT DOCUMENTS 7,728,803 B2 * 6/2010 Hu ..... 345/89

* cited by examiner

*Primary Examiner* — Antonio A Caschera
(74) *Attorney, Agent, or Firm* — McKenna Long & Aldridge LLP

(57) ABSTRACT

An LCD device and an LCD driving method select one among a plurality of threshold values provided along gray level regions of the pixel data as a threshold value for pixel data in a current frame interval. Accordingly, the number of times over-driving occurs due to noise when a still image is displayed can be minimized.

11 Claims, 2 Drawing Sheets

LIQUID CRYSTAL DISPLAY DEVICE AND DRIVING METHOD THEREOF

This application claims priority under 35 U.S.C. 119 to Korean Patent Application No. 10-2008-0096509, filed on Oct. 1, 2008, which is hereby incorporated by reference in its entirety for all purposes as if incorporated herein.

BACKGROUND

1. Field of the Disclosure

This disclosure relates to a liquid crystal display (LCD) device, and more particularly to a liquid crystal display device adapted to minimize abnormal over-driving caused by noise, and a driving method thereof.

2. Description of the Related Art

The visibility enhancement of motion images is a central concern when realizing a high picture-quality display device, specifically a high picture-quality LCD device. If the motion image is displayed through a commercial LCD device, the motion of an object is shown as blurred. In other words, motion blur phenomenon occurs in commercial LCD devices. The motion blur phenomenon results from a hold type display characteristic of the LCD device and the fact that the human eye recognizes a moving object by tracking the object and integrating its motion. This motion blur phenomenon becomes more severe as the speed of the moving object increases.

To address this matter, a liquid crystal capable of replying in high-speed and an over-driving method for the fast achievement of a target gradation have been proposed, and further methods for enhancing the response time of middle gradations continue to be researched.

The over-driving method supplies a liquid crystal panel with pixel data having a gray level higher than that of the input pixel data, thereby temporarily enhancing the response time of the liquid crystal. Since the response time of the liquid crystal is enhanced by the over-driving, the motion blur phenomenon displayed on the liquid crystal panel can be minimized. More specifically, in order to enhance the response time of the liquid crystal, the over-driving method compares the pixel data of the current frame from the exterior with the pixel data of the previous frame and supplies the liquid crystal panel with pixel data having a gradation higher than that of the pixel data of the current frame on the basis of the compared resultant.

If a noise component is included in the pixel data of the current frame during the period of several frames during which a still image is displayed on the liquid crystal panel the pixel data of the current frame is varied. In this case, the LCD device compares the varied pixel data with the pixel data of the previous frame and performs the over-driving because it recognizes the varied pixel data as pixel data different from that of the previous frame.

In this way, when the noise component is included in the pixel data of the current frame, the LCD device performs the over-driving and displays an image different from the still image, thereby generating a visual picture-quality abnormality.

BRIEF SUMMARY

Accordingly, the present embodiments are directed to an LCD device that substantially obviates one or more of problems due to the limitations and disadvantages of the related art.

An object of the present embodiment is to provide an LCD device that is adapted to minimize abnormal over-driving times due to noise and to prevent the visual picture-quality abnormality when a still image is displayed, and a driving method thereof.

Another object of the present embodiment is to provide an LCD device capable of enhancing the picture quality, and a driving method thereof.

Still another object of the present embodiment is to provide an LCD device capable of reducing power consumption, and a driving method thereof.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes: a liquid crystal panel with pixels arranged in a matrix pattern; an input portion receiving pixel data in a frame unit; a driver driving the liquid crystal panel; a frame memory delaying the pixel data from the input portion during one frame period; a data difference calculator calculating a data difference value between the delayed pixel data from the frame memory and the received pixel data from the input portion; a threshold determiner determining a threshold value, corresponding to the received pixel data from the input portion, among a plurality of threshold values which are established along divided gray level ranges of the pixel data; a comparator comparing the determined threshold value from the threshold determiner with the data difference value from the data difference calculator and generating a comparing signal in correspondence with the compared resultant; and an over-driver selectively performing an over-driving operation according to the comparing signal.

An LCD device driving method according to another general aspect of the present embodiment may be applied to an LCD device including a liquid crystal panel with pixels arranged in a matrix pattern, an input portion receiving pixel data in a frame unit, and a driver driving the liquid crystal panel. The method includes; delaying the pixel data from the input portion during one frame period; calculating a data difference value between the delayed pixel data and the received pixel data from the input portion; determining a threshold value, corresponding to the received pixel data from the input portion, among a plurality of threshold values which are established along divided gray level ranges of the pixel data; comparing the determined threshold value with the calculated data difference value to generate a comparing signal in correspondence with the compared resultant; and selectively performing an over-driving operation according to the comparing signal.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
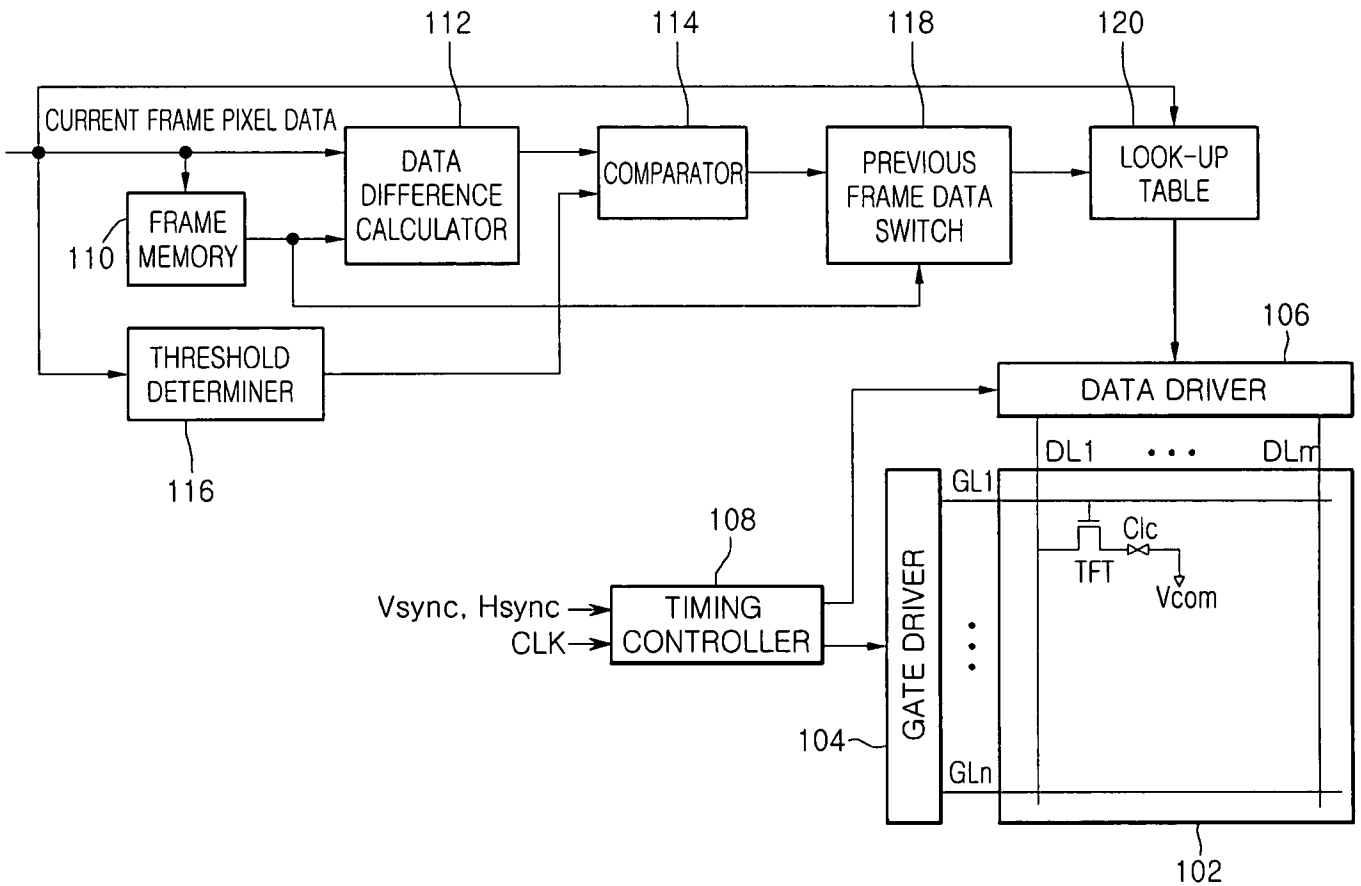
FIG. 1 is a view showing an LCD device according to an embodiment of the present disclosure.

Reference will now be made in detail to the embodiments of the present disclosure, examples of which are illustrated in the accompanying drawings. These introduced embodiments are provided as examples in order to convey their state to a person with ordinary skill in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

FIG. 1 is a view showing an LCD device according to an embodiment of the present disclosure.

As shown in FIG. 1, the LCD device according to the embodiment of the present disclosure includes a liquid crystal panel 102 displaying images, a gate driver 104 driving a plurality of gate lines GL1~GLn on the liquid crystal panel 102, a data driver 106 driving a plurality of data lines DL1~DLm on the liquid crystal panel 102, and a timing controller 108 controlling the driving time of the gate and data drivers 104 and 106.

The liquid crystal panel 102 includes pixels each formed in regions which are defined by the plural gate lines GL1~GLn and the plural data lines DL1~DLm. Each of the pixels includes a thin film transistor TFT formed at an intersection of the respective gate line GL and the respective data line DL, and a liquid crystal cell Clc connected between the thin film transistor TFT and a common electrode Vcom.

The thin film transistor TFT responds to a gate scan signal on the respective gate line GL and switches a pixel data voltage to be applied from the respective data line DL to the respective liquid crystal cell Clc. The liquid crystal cell Clc includes both the common electrode Vcom and a pixel electrode opposite each other in the center of a liquid crystal layer. The pixel electrode is connected to the respective thin film transistor TFT. Such a liquid crystal cell Clc charges the pixel data voltage applied through the respective thin film transistor TFT. Also, the liquid crystal cell Clc updates the charged voltage whenever the respective thin film transistor TFT is turned on.

In addition, each of the pixels on the liquid crystal panel 102 includes a storage capacitor Cst connected between the respective thin film transistor TFT and its previous gate line GL. The storage capacitor Cst minimizes a natural decrease in the charged voltage of the liquid crystal cell Clc The gate driver 104 responds to gate control signals GCS from the timing controller 108 and applies the plural gate scan signals to the plural gate lines GL1~GLn, respectively. The plural gate scan signals allows the plural gate lines GL1~GLn to be sequentially enabled in one horizontal synchronous signal period.

The data driver 106, responsive to data control signals DCS from the timing controller 108, generates a plurality of pixel data voltages and applies them to the plural data lines DL1~DLm on the liquid crystal panel 102 whenever any one of the plural gate lines GL1~GLn is enabled. To this end, the data driver 106 inputs pixel data for one line from the timing controller 108 in each time interval and converts the input pixel data for one line into the pixel data voltages of an analog signal shape using a gamma voltage set.

The timing controller 108 uses a data clock CLK, a horizontal synchronous signal Hsync, a vertical synchronous signal Vsync, and a data enable signal DE from an external system (not shown) such as the graphic module of a computer system or the image demodulation module of a television receiving system, and generates the gate control signals GCS, the data control signals DCS, and a polarity inversion signal POL. The gate control signals are applied to the gate driver 104, while the data control signal DCS and the polarity inversion signal POL are supplied to the data driver 106.

The LCD device according to the embodiment of present disclosure further includes a frame memory, a data difference calculator 112, a threshold determiner 116, a comparator 116, a previous frame data switch 118 and a look-up table. The frame memory stores and delays the pixel data input in a frame unit by one frame period. The data difference calculator 112 calculates a difference value between the previous frame pixel data one-frame-delayed by means of the frame memory 110 and the current frame pixel data input from the external system. The threshold determiner 116 determines a threshold value corresponding to a gray level value of the current frame pixel data. The comparator 114 compares the threshold value from the threshold determiner 116 with the data difference value from the difference calculator 112 in order to generate a comparing signal for the compared resultant The previous frame data switch 118 selectively outputs the previous frame pixel data according to the comparing signal. Finally, the look-up table outputs an over-driving compensation data on the basis of the current frame pixel data from the external system or a combination of the current and previous frame pixel data according to whether or not the previous frame data switch outputs the previous frame pixel data.

The frame memory 110 stores the pixel data from the external system during the current frame period so that the pixel data is delayed by one frame period (or interval). Consequently, the previous frame pixel data delayed by one frame period is applied from the frame memory 110 to the data difference calculator 112.

The data difference calculator 112 calculates the data difference value between the previous frame pixel data from the frame memory 110 and the current frame pixel data applied from the external system. The data difference value calculated by the data difference calculator 112 is then applied to the comparator 114.

The threshold determiner 116 includes a plurality of threshold values which are set up differently along gray level ranges into which a gray scale of the pixel data is divided. The threshold determiner 116 checks whether the gray value of the current frame pixel data from the external system is included in any one among the plural level ranges. Also, the threshold determiner 116 selects a threshold value corresponding to the gray level range, which includes the gray value of the current frame pixel data, among the plural threshold values. The selected threshold value is applied to the comparator 114 as the threshold value for the current frame pixel data.

For example, the threshold determiner 116 can include 16 threshold values dividing the pixel data gray scale of 0~255 into 16 gray level ranges, as shown in table 1 below.

TABLE 1

| | Current frame data | | | | | |
|---|---|---|---|---|---|---|
| | G0~G15 | G16~G31 | G32~G47 | . . . | G223~G238 | G239~G255 |
| Threshold value | TH1 | TH2 | TH3 | . . . | TH15 | TH16 |

If the current frame pixel data of a $5^{th}$ gray level G5 is input, the threshold determiner 116 selects a first threshold value TH1 corresponding to a first gray level range which includes the $5^{th}$ gray level G5 and then applies the first threshold value TH1 to the comparator 114. Similarly, when the current frame pixel data of a $30^{th}$ gray level G30 is input, the threshold determiner 116 selects a second threshold value TH2 corresponding to a second gray level range which includes the $30^{th}$ gray level G30 and applies the second threshold value TH2 to the comparator 114. In this way, the gray value of the threshold values is determined.

The threshold values TH provided in the threshold determiner 116 can be increased or decreased in number according to the user. In other words, the gray level ranges can become wider or narrower in width.

In general, image-noises displayed by over-driving the pixel data have visible degrees which differ from each other according to a dark region (a low gray level range) and a bright region (or a high gray level range). For example, an image-noise displayed by over-driving the pixel data of the low gray value with 10 gray levels is more visible than that displayed by over-driving the pixel data of the low gray value with 10 gray levels. In view of this point, the threshold determiner 116 allots a small value to the threshold value for the lower gray level range, and a large value to the threshold value for the higher gray level range.

The comparator 114 compares the selected threshold value from threshold determiner 116 with the data difference value calculated in the data difference calculator 112. Also, the comparator 114 generates the comparing signal in correspondence with the compared resultant.

For example, when the current frame pixel data and the previous frame pixel data have a gray value G5 of "5" and a gray value G0 of "0", respectively, the threshold value becomes a first threshold value TH1 and the data difference value is "0". In this case, if the first threshold value TH1 has a gray value of "4", the data difference value is larger than the first threshold value TH1. As such, the comparator 114 may generate the comparing signal of the specific logic value (i.e., high).

The comparator 114 generates the comparing signal of a specific logic value (for example, a high logic signal) when the calculated data difference value from the data difference calculator 112 is larger than the selected threshold value TH from the threshold determiner 116.

On the contrary, when the calculated data difference value from the data difference calculator 112 is smaller than or equal to the selected threshold value TH from the threshold determiner 116, the comparator 114 generates the comparing signal of a basic logic value (for example, a low logic signal).

The comparing signal generated in the comparator 114 is applied to the previous frame data switch 118.

The previous frame data switch 118 determines whether or not it outputs the previous frame pixel data from the frame memory 110 to the look-up table 120. When the comparing signal of the specific logic value (high) is applied from the comparator 114, the previous frame data switch 118 supplies the look-up table 120 with the previous frame pixel data from the frame memory 110. On the contrary, when the comparing signal of the basic logic value (low) is applied from the comparator 114, the previous frame data switch 118 forces the previous frame pixel data from the frame memory 110 not to be applied to the look-up table 120.

The current frame pixel data from the external system and the previous frame pixel data from the previous frame data switch 118 are input into the look-up table 120.

The look-up table 120 uses the current frame pixel data from the external system as an X-axis address and the previous frame pixel data from the previous frame data switch 118 as a Y-axis address. Also, the look-up table 120 includes the over-driving compensation data stored in each region which corresponds to the X-axis and Y-axis addresses. The over-driving compensation data is established in a manner to over-compensate the current frame pixel data from the external system in a different gray value ratio.

When the current frame pixel data from the external system and the previous frame pixel data from the previous frame data switch 118 are applied, the look-up table 120 reads the over-driving compensation data in the storing region corresponding to the gray values of the current frame pixel data and the previous frame pixel data and outputs this over-driving compensation data to the data driver 106. On the other hand, when the current frame pixel data from the external system is applied and the previous frame pixel data from the previous frame data switch is not applied, the look-up table 120 transfers the current frame pixel data from the external system to the data driver 106.

In other words, the current frame pixel data from the external system is originally applied to the data driver 106 without the over-driving compensation, when the difference value between the current frame pixel data and the previous frame pixel data is smaller than the threshold value determined by the threshold determiner 116. On the contrary, when the difference value between the current frame pixel data and the previous pixel data is larger than the threshold value determined by the threshold determiner 116, the current frame pixel is compensated for over-driving before being applied to the data driver 106.

More specifically, if a still image not having any difference between the previous frame pixel data and the current frame pixel data is displayed, the data difference value is "0" and is smaller than the threshold value determined by the threshold determiner 116. In this case, the current frame pixel data is originally output to the data driver 106 so that the liquid crystal panel 102 displays the same picture as the previous frame data.

Although the still image not having any difference between the previous frame pixel data and the current frame pixel data is displayed, the current frame pixel data can change by including a noise. As such, a difference is generated between the current frame pixel data and the previous frame pixel data. In this case, if the difference value is smaller than the threshold value determined by the threshold determiner 116, the current frame pixel data is originally output to the data driver 106. On the contrary, if the difference value is larger than the threshold value selected by the threshold determiner 116, the over-driving compensation data instead of the current frame pixel data is output to the data driver 106.

As described above, the LCD device according to the embodiment of the present disclosure is over-driven only when the difference value between the previous frame pixel data and the current frame pixel data is larger than the threshold value determined by the threshold determiner 116, even though the current frame pixel data changes due to the inclusion of noise and has a different value from the previous frame pixel data. Accordingly, the LCD device can reduce the number of times over-driving occurs in comparison with the related art LCD device which is over-driven whenever there is a difference between the current frame pixel data and the previous frame pixel data.

Also, the related art LCD device is over-driven whenever there is a difference between the current frame pixel data and the previous frame pixel data, thereby causing the visual picture-quality abnormality. However, the LCD device of the present embodiment is over-driven only when the difference value between the previous frame pixel data and the current frame pixel data is larger than the threshold value determined by the threshold determiner 116, even though noise is included in the current frame pixel data. Therefore, the LCD device of the present embodiment can reduce the times the visual picture-quality abnormality is generated.

Figure 2:
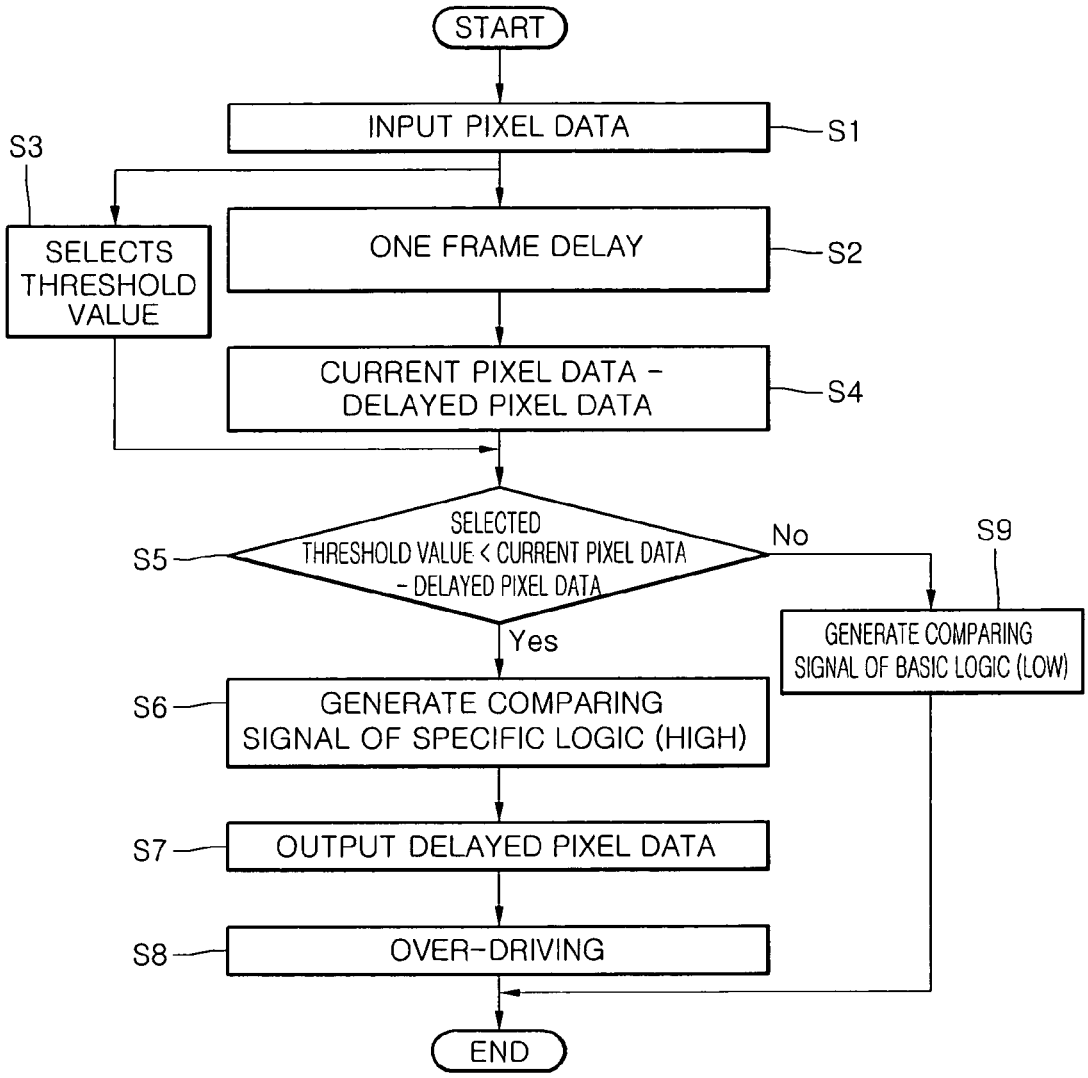
FIG. 2 is a flow chart explaining a process of determining whether or not over-driving of the LCD device of FIG. 1 occurs.

FIG. 2 is a flow chart explaining a process of determining whether or not over-driving of the LCD device of FIG. 1 occurs.

Referring to FIGS. 1 and 2, when the current frame pixel data is input from the external system (S1), the LCD device of the present embodiment stores the current frame pixel data in the frame memory 110 and delays the current frame pixel data by one frame period (S2). In other words, the LCD device provides the previous frame pixel data. The threshold determiner 116 selects a threshold value, corresponding to the gray value of the current frame pixel data from the external system, from among a plurality of threshold values which are previously established (S3). A data difference value between the current frame pixel data and the previous frame pixel data is calculated (S4).

Sequentially, the LCD device of the present embodiment compares the selected threshold value with the calculated data difference value (S5). If the calculated data difference value is larger than the selected threshold value, the comparing signal of a specific logic (i.e., High) is generated (S6). In this case, the comparing signal enables the previous frame pixel data to be applied to the look-up table 118 (S7) so that the LCD device is over-driven (S8).

On the contrary, if the calculated data difference value is equal to or smaller than the selected threshold value, the comparing signal of a basic logic (i.e., Low) is generated (S9). As such, the LCD device of the present embodiment is not over-driven. In this case, the current frame pixel data is originally output to the data driver 106.

In other words, the LCD device of the present embodiment calculates the data difference value between the current frame pixel data from the external system and the previous frame pixel data. It determines the threshold value corresponding to the gray value of the current frame pixel data from the external system among the plural threshold values which are previously established along the divided gray level ranges of the pixel data. It then compares the calculated data difference value with the determined threshold value, thereby selectively performing the over-driving operation according to the compared resultant.

Therefore, such an LCD device is over-driven only when the difference value between the previous frame pixel data and the current frame pixel data is larger than the threshold value determined by the threshold determiner 116, even though the current frame pixel data changes due to the inclusion of noise and differs from the previous frame pixel data during the displaying period of a still image. As a result, the LCD device of the present embodiment can reduce the number of times over-driving occurs in comparison with the related art LCD device which is over-driven whenever the current frame pixel data differs even slightly from the previous frame pixel data.

Furthermore, the LCD device of the embodiment of present disclosure can reduce the electric power consumption because it reduces the number of times over-driving occurs in comparison with the related art LCD device.

It will be apparent to those skilled in the art that various modifications and variations can be made in the present disclosure. Thus, it is intended that the present disclosure cover the modifications and variations of this embodiment provided they come within the scope of the appended claims and their equivalents.

What is claimed is:

1. A liquid crystal display device comprising:

a liquid crystal panel with pixels arranged in a matrix pattern;

an input portion receiving pixel data in a frame unit;

a driver driving the liquid crystal panel;

a frame memory delaying the pixel data from the input portion during one frame period;

a data difference calculator calculating a data difference value between the delayed pixel data from the frame memory and the received pixel data from the input portion;

a threshold determiner determining a threshold value, corresponding to the received pixel data from the input portion, among a plurality of threshold values which are established along divided gray level ranges of the pixel data;

a comparator comparing the determined threshold value from the threshold determiner with the data difference value from the data difference calculator and generating a comparing signal in correspondence with the compared resultant;

an over-driver selectively performing an over-driving operation according to the comparing signal;

a previous frame data switch to determine whether or not it outputs the delayed frame pixel data from the frame memory to the over-driver according to a logic value of the comparing signal, wherein the threshold determiner checks whether a gray value of the current frame pixel data from an external system is included in any one among the plural level ranges.

2. The liquid crystal display device according to claim 1, wherein the over-driver includes a look-up table.

3. The liquid crystal display device claimed as claim 1, wherein the comparator generates the comparing signal of a high specific logic value (High) when the data difference value from the data difference calculator is larger than the determined threshold value from the threshold determiner.

4. The liquid crystal display device claimed as claim 1, wherein the comparator generates the comparing signal of a low basic logic value (Low) when the data difference value from the data difference calculator is equal to or smaller than the determined threshold value from the threshold determiner.

5. The liquid crystal display device claimed as claim 1, wherein the over-driver is driven only when the data difference value from the data difference calculator is larger than the determined threshold value from the threshold determiner.

6. The liquid crystal display device claimed as claim 1, wherein the previous frame data switch supplies the over-driver with the delayed frame pixel data from the frame memory, when the comparing signal with the high logic value is applied from the comparator.

7. The liquid crystal display device claimed as claim 1, wherein the previous frame data switch forces the delayed frame pixel data from the frame memory not to be applied to the over-driver, when the comparing signal with the low logic value is applied from the comparator.

8. A method of driving a liquid crystal display device including a liquid crystal panel with pixels arranged in a matrix shape, an input portion receiving pixel data in a frame unit, and a driver driving the liquid crystal panel, a frame memory delaying the pixel data from the input portion during one frame period, a data difference calculator calculating a data difference value between the delayed pixel data from the frame memory and the received pixel data from the input portion, and a threshold determiner including a plurality of threshold values which are set up differently along gray level ranges into which a gray scale of the pixel data is divided the method comprising:

selecting a threshold value corresponding to the gray value of a current frame pixel data from an external system from among a plurality of threshold values;

comparing the selected threshold value with the calculated data difference value and generating a comparing signal in correspondence with the compared resultant;

determining an over-driving operation of the driver according to a logic value of the comparing signal;

determining whether or not a previous frame data switch outputs the delayed frame pixel data from the frame memory to the over-driving operation according to a logic value of the comparing signal;

delaying the pixel data from the input portion during one frame period;

calculating a data difference value between the delayed pixel data and the received pixel data from the input portion;

determining a threshold value, corresponding to the received pixel data from the input portion, among a plurality of threshold values which are established along divided gray level ranges of the pixel data, comparing the determined threshold value with the calculated data difference value to generate a comparing signal in correspondence with the compared resultant; and selectively performing an over-driving operation according to the comparing signal.

9. The method claimed as claim 8, wherein the over-driving operation is performed only when the calculated data difference value is larger than the determined threshold value.

10. The method claimed as claim 8, wherein generating a comparing signal comprises generating the comparing signal of high logic value when the data difference value is larger than the selected threshold value.

11. The method claimed as claim 8, wherein generating a comparing signal comprises generating the comparing signal of low logic value when the data difference value is equal to or smaller than the determined threshold value.

* * * * *